US006889838B2

(12) United States Patent
Meier et al.

(10) Patent No.: US 6,889,838 B2
(45) Date of Patent: May 10, 2005

(54) TOOL BOX

(75) Inventors: Sven Meier, Düsseldorf (DE); Vitus Müller-Chorus, Winnenden (DE); Horst Garbrecht, Ostelsheim (DE)

(73) Assignee: Atlas Copco Electric Tools GmbH, Winnenden (DE)

( * ) Notice: Subject to any disclaimer, the term of this patent is extended or adjusted under 35 U.S.C. 154(b) by 0 days.

(21) Appl. No.: 10/248,632

(22) Filed: Feb. 3, 2003

(65) Prior Publication Data

US 2003/0094392 A1 May 22, 2003

Related U.S. Application Data

(63) Continuation of application No. PCT/EP00/07504, filed on Aug. 3, 2000, now abandoned.

(51) Int. Cl.[7] ..... B65D 21/00
(52) U.S. Cl. ..... 206/508; 206/509; 206/511
(58) Field of Search ..... 206/508, 509, 206/511, 512, 4.26, 4.27; 217/40

(56) References Cited

U.S. PATENT DOCUMENTS

| | | | | | |
|---|---|---|---|---|---|
| 2,005,528 | A | * | 6/1935 | Berchulc | 220/761 |
| 3,448,914 | A | * | 6/1969 | Scholz | 206/509 |
| 3,481,505 | A | * | 12/1969 | Nason et al. | 220/560.1 |
| 3,616,943 | A | * | 11/1971 | Brink | 206/508 |
| 4,042,111 | A | * | 8/1977 | Smith | 206/508 |
| 4,078,701 | A | * | 3/1978 | Clubb | 222/130 |
| D260,237 | S | * | 8/1981 | Fuzere | |
| 4,593,816 | A | * | 6/1986 | Langenbeck | 206/425 |
| 5,022,546 | A | * | 6/1991 | Bock | 220/4.03 |
| 5,275,300 | A | * | 1/1994 | Johnson | 217/5 |
| 5,332,114 | A | * | 7/1994 | Sano et al. | 220/4.24 |
| 5,392,945 | A | * | 2/1995 | Syrek | 220/608 |
| 5,464,115 | A | * | 11/1995 | Tisbo et al. | 220/324 |
| 5,515,993 | A | * | 5/1996 | McManus | 220/4.23 |
| 5,577,613 | A | * | 11/1996 | Laidlaw | 206/510 |
| 5,699,925 | A | * | 12/1997 | Petruzzi | 220/4.27 |

FOREIGN PATENT DOCUMENTS

| | | |
|---|---|---|
| DE | 34 07 043 | 9/1985 |
| DE | 299 00 082 | 4/1999 |
| EP | 0 555 533 | 8/1993 |
| FR | 2 625 727 | 7/1989 |

* cited by examiner

*Primary Examiner*—Joseph Man-Fu Moy
(74) *Attorney, Agent, or Firm*—Gudrun E. Huckett

(57) ABSTRACT

A stacking tool case vertically stackable with additional stacking tool cases having an identical configuration has a shell-shaped bottom part having an opening facing in an upward vertical direction. A cover closes the opening. The bottom part has stacking posts extending in the upward vertical direction, wherein the cover in a closed state of the tool case is arranged between the stacking posts. The stacking posts support a bottom part of a stacking tool case placed on top.

25 Claims, 8 Drawing Sheets

TOOL BOX

CROSS REFERENCE TO RELATED APPLICATIONS

This is a continuation of International Application PCT/EP00/07504 with an international filing date of Aug. 3, 2000, not published in English under PCT Article 21(2), and now abandoned.

BACKGROUND OF INVENTION

1. Field of the Invention

The invention relates to tool box or tool case, in particular, for receiving portable working devices. The tool box or tool case can be stacked vertically and comprises a shell-shaped bottom part with an upwardly facing opening as well as a cover for closing the opening.

2. Description of the Related Art

For storing and transporting portable working devices, such as hand-held electric tools, drills or the like as well as for heavy tools in general, a plurality of tool boxes are known which must fulfill several, partially contradictory requirements. For example, for storing new devices, the tool boxes enclosing them must be stackable easily and the storage space occupied by them should be as small as possible. This results in requirements demanding a stacking height as high as possible in connection with a compact configuration. Because of the resulting high mechanical loads acting on the tool box at the bottom of the stack, the tool boxes must be configured to be correspondingly strong. At the same time, a minimal weight of the tool box itself is desirable, for example, in order to enable easy handling of the tool box at a construction site.

European patent 0 555 533 describes a stackable tool box or tool case for transportable machine tools which comprises a box or shell-shaped bottom part and a cover. Stacking several of these boxes is possible in that the bottom part of the box on top is placed onto the cover of the box arranged underneath, respectively. The cover of the box in the lower position, respectively, is secured between the bottom part of the lower box and the lower part of the box placed directly on top. In the stacked condition, such a cover must therefore be able to support the weight of one or several such stacked boxes and their contents. The cover is thus significantly stressed which can result in damage of the cover itself or of its hinges and closures. Connecting means are provided which enable a detachable connection between the bottom parts of two boxes that are directly stacked on top, respectively, and the formation of a contiguous transport unit comprised of several boxes. This supposedly provides the possibility of lifting the stack of boxes by engaging the uppermost box wherein the lower boxes are suspended from the top one, respectively, by means of the connecting means. For a tight connection which prevents or inhibits sliding of the boxes relative to one another a certain pretensioning force of the connecting means is required.

SUMMARY OF INVENTION

It is an object of the present invention to provide a tool box or tool case of the aforementioned kind such that its stackability is improved and its loading in the stacked state is reduced.

In accordance with the present invention, this is achieved in that on the bottom part stacking posts are provided which extend in the vertical direction and between which a cover forming the lid of the tool box is positioned in the closed state. The bottom part of a tool box stacked on top is supported on these stacking posts.

Accordingly, it is suggested to provide the bottom part of a tool box with stacking posts which extend in the vertical direction and between which a cover forming the lid is positioned in the closed state of the box. The bottom part and the stacking posts connected thereto are configured such that the bottom part of the tool box stacked on top is supported on the stacking posts of the lower tool box, respectively. In this way, the cover in the stacked state does not have to provide a static or supporting function. Therefore, it can be configured, particularly together with the possibly present hinges and closures, to be correspondingly lightweight and simple. Moreover, this provides the possibility of configuring the cover or lid in accordance with the requirements of the opening of the tool box to be covered and of the tools to be transported without having to take into account the static loading force during stack formation.

In an expedient further embodiment, a drawer arrangement with a housing part and a horizontally slidable drawer, for example, for auxiliary delivery parts, is provided. The drawer arrangement is configured to match the tool box in that the stacking posts, in particular, in the sidewalls, receive the weight forces so that the drawer is substantially free of any load. The drawer can therefore be pulled forwardly out of the housing part without detaching or releasing the connection to the tool box positioned above.

In particular by providing a monolithic or unitary configuration of the stacking posts with the bottom part, a continuous force transmission without connecting locations that represent a weak point can be obtained so that high stacks can be formed even with heavy working devices inserted in the tool boxes. Possibly occurring impact loads, for example, at construction sites can be received in an improved way. In this connection, the cover expediently has a spacing in the vertical direction to the bottom part positioned above in the stacked state of the tool boxes. In this way, it is ensured that, even when the cover, the bottom part or both are soiled, a force transmission in the stacked state from the bottom part to the cover positioned underneath is prevented. By means of the spacing it is also possible to open the cover at least somewhat in the stacked state so that it is possible to check whether the box in question within the stack contains a tool.

Advantageously, two oppositely positioned sidewalls of the bottom part extend laterally past the cover in the upward direction and in this way form support posts. The constructive expenditure for such a configuration is minimal. In the stacked state, the sidewalls are loaded within their plane so that a high bearing capacity is provided even for thin-walled and correspondingly lightweight configurations.

The cover positioned between the sidewalls can be designed to have a large surface area so that an unimpeded access to the contents of the tool box is enabled. Expediently, the cover is connected with hinges to the back wall positioned between the sidewalls of the bottom part so that the cover is pivotable. The cover can be secured on the front wall positioned opposite the back wall of the bottom part by closure means. By means of the connection with hinges the cover is fixed on the bottom part and cannot be lost. In connection with the laterally upwardly extending sidewalls, a free pivoting action of the cover is possible which facilitates access to the interior of the tool box. Expediently, two closures are provided and displaced relative to the center of the front wall. In this way, on the one hand, a simple opening and closing of the cover is enabled because the operator can simultaneously actuate a closure with each hand. In connection with the hinges this provides an excellent distribution of the force transmission between the cover and the bottom part which avoids pointed force peaks on the cover and enables a corresponding lightweight configuration.

The closures are advantageously recessed relative to the outer contour of the tool box in the closed state. This prevents that the closures are accidentally impacted or torn off and also contributes to the reduction of the required storage space when in the stacked state. The closures are advantageously configured such that upon closing of the cover they snap into place automatically so that the cover can no longer open automatically. This increases the security against accidental dropping of the contents of the tool box. For completely closing the closures, the closures are subsequently manually pushed into their locking position.

The stackability is further improved in that means are provided against sliding of the tool boxes stacked on top one another in a direction transverse to the vertical direction. These means are in particular projections and guide recesses or depressions which engage one another in a positive-locking way and are expediently provided with lateral slants. In this way, a precisely aligned stack formation with corresponding minimal storage space is enabled. When transporting the tool boxes, for example, in a vehicle, to a construction site, relative sliding of tool boxes stacked on top one another is prevented. Because of the slants the formation of a stack is simplified because an upper tool box must not be placed precisely aligned onto the lower one but only approximately in the correct position because the lateral slants provide for sliding of the projections into the corresponding guide recesses. In particular, the projections are provided at the bottom part and are configured such that relative to its bottom they project vertically downwardly. In addition to their function as stacking aids, the projections can also take over the function of legs for a single tool box to be placed on the ground.

In an advantageous configuration, the cover is provided with guide recesses which laterally adjoin the sidewalls, respectively. They are configured such that projections of a bottom part positioned above and engaging them can be supported at the inner sides of the sidewalls. In this way, for realizing a lateral guiding action, the arrangement of guide recesses on the topside of the sidewalls is no longer required so that the sidewalls can be designed to be very narrow and the cover can be very wide.

The guide recesses are expediently provided in the area of the back wall and the front wall wherein the guide recesses in the area of the front wall are separated from those in the area of the back wall by stop surfaces. In this connection, correspondingly shaped projections with matching stop surfaces are provided which engage these guide recesses when the boxes are stacked. The contacting stop surfaces serve in this connection as securing means against sliding in a direction from the front wall to the back wall and vice versa. In this connection, it may be expedient to provide an open design of the guide recesses in a direction toward the adjoining back wall or the adjoining front wall. In this way, it is possible, for example, to place a tool box in an inclined position from the front onto a lower tool box and to slide it to the rear in the direction toward the back wall. In this connection, the projections in the area of the front wall can glide into corresponding open guide recesses until the rearward projections in the area of the back wall are positioned above their corresponding guide recesses and, in particular, are guided by the slants into the guide recesses and glide into them.

As a further means for securing against sliding, in particular, in the direction parallel to the sidewalls, the sidewalls have at their upwardly facing top side a recess and at the opposite bottom side a corresponding raised portion. When stacking the tool boxes, the raised portions positioned at the bottom of an upper tool box engage the corresponding recesses at the top side in the sidewalls of the lower tool box and thus provide positive locking action. In particular, the recesses and the raised portions are limited by inclined pressure surfaces which when the boxes are stacked can be placed against one another and, in a precise way, provide a precise positive-locking action such that the forces in the vertical as well as horizontal direction can be received by them. In this way, a precisely defined location of the force introduction is provided which can be reinforced locally by constructive means while the other areas of the sidewalls can be designed simply and light-weight.

In this connection it may be expedient to shape the top side of the sidewalls convexly and the bottom side concavely. The concave curvature of the bottom side prevents that a single tool box placed onto a planar surface will contact the ground with its projection so that a tilting-resistant placement of the tool box is enabled. When forming a stack of the tool boxes, the concavely curved bottom sides of the sidewalls are positioned a really on the corresponding convexly curved topsides and enable an a real stable force transmission into the sidewalls without loading the cover. With the differently designed curvature of the top and bottom sides, the top side with the cover can be recognized by the user at first glance even absent any further markings so that placement of the tool box with its topside in an upside down position, and the corresponding well-known results upon opening the box in the upside down position, are prevented.

In an advantageous configuration, means are provided. In particular, for a detachable, positive-locking connection in the vertical direction of the tool boxes stacked on top one another so that it is possible to carry several stacked tool boxes by gripping a single handle. In connection with the above described means against lateral sliding, a positive-locking connection of individual tool boxes relative to one another is achieved in all three spatial direction so that the stack formed in this way can also be tilted laterally and subsequently, for example, by means of a handle connected to the front side can be lifted and carried. The corresponding connecting means are expediently provided on the support posts and, in particular, on the sidewalls formed by the support posts. With such a configuration, additional reinforcements are not needed because of the already present bearing capacity of the sidewalls so that the remaining areas of the tool box can be of a corresponding lightweight construction. For this purpose, in the area of the top side and the bottom side of the two sidewalls, a rib is provided, respectively, wherein the upper rib of the lower tool box and a neighboring lower rib of the upper tool box stacked on top are engaged by a clamp. This configuration comprising a clamp and ribs provides a high carrying capacity despite its simple constructive design and despite its minimal manufacturing expenditure.

The clamps are expediently pivotably secured on the respective sidewalls so that they will not be lost in the released state. The clamps or brackets can advantageously be configured as pivotable holding grips so that they have a double function. The clamps in the lower area of a tool box stack connect the tool boxes positive-lockingly with one another in the vertical direction while the uppermost clamps are pivoted laterally outwardly and can be used as holding grips for lifting or carrying the entire stack. By providing locking recesses in which the means for providing the positive-locking connection can be immersed, the required storage space is minimal. For example, in the case of adjacently positioned stacks in a shelf system, individual tool boxes can be pulled out forwardly without the lateral clamps of neighboring stacks becoming hooked or catching on one another.

As a securing means for unauthorized access to a valuable device stored in the tool box, the cover is expediently secured on the bottom part so as to be locked by a key. For this purpose, in the front wall and in the adjacent area of the cover an opening is provided in a simple and effective configuration through which, for example, a padlock can be pushed.

For obtaining a high bearing capacity with minimal weight and acceptable manufacturing costs, the tool box and, in particular, its bottom part, the cover, and the clamps are manufactured of plastic material. In the case of a complex geometric configuration of the tool box, processing of the plastic material by way of injection molding is expedient. For a high bearing capacity in connection with a corresponding impact resistance and excellent processability, polypropylene or ABS (acrylonitrile butadiene styrene) have been found to be expedient.

BRIEF DESCRIPTION OF DRAWINGS

FIG. 9 is an overview illustration of a drawer arrangement together with a tool box stacked on top.

DETAILED DESCRIPTION

Figure 1:
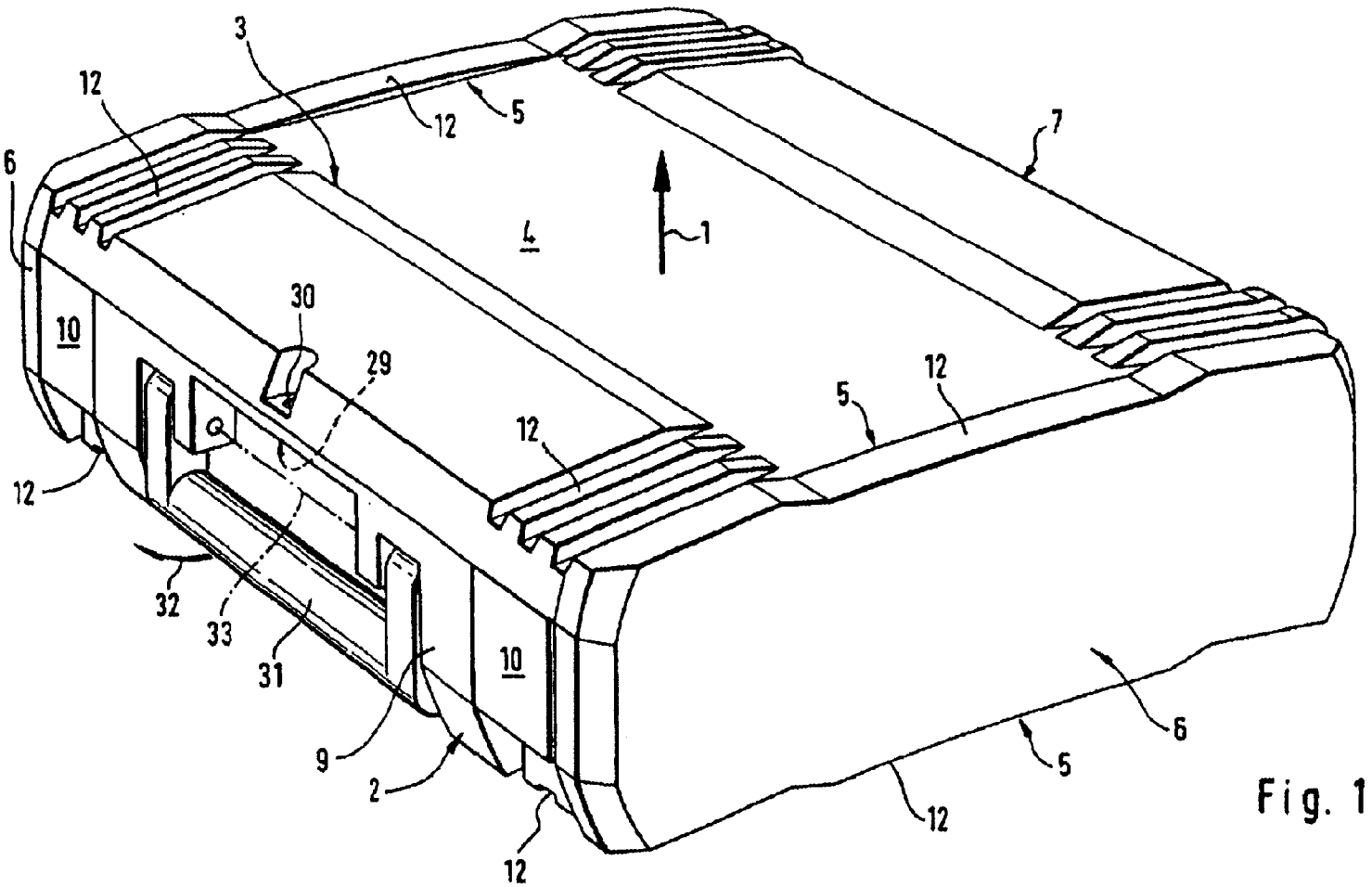
FIG. 1 is a perspective view of a tool box with sidewalls formed as stacking posts.

FIG. 1 illustrates a tool box according to the invention whose bottom part 2 has an opening 3 facing upwardly in the vertical upward direction 1. The cover 4 is provided to close the opening 3. The cover 4 is pivotably secured in the area of the back wall 7 of the bottom part 2 by means of hinges 8 illustrated in detail in FIG. 5 and in the area of the front wall 9, opposite the back wall 7, secured in the closed state by two closures 10. However, an embodiment may be expedient in which the cover 4 can be detachably secured without hinges 8 by means of additional closures 10 or snap-on connections on the back wall 7 and/or on the sidewalls 6. The two sidewalls 6 of the bottom part 2 are extended laterally upwardly past the cover 4 in the upward direction and form stacking posts 5. It may be expedient to provide separately configured stacking posts 5 in the area of the sidewalls, the back wall 7 and/or the front wall 9. A carrying grip or handle 31 is provided on the front wall 9 and is pivotable about an axis 33 in the direction of arrow 32. The carrying grip 31 and the two closures 10 are recessed in the illustrated rest position or closed position relative to the outer contour of the tool box. The cover 4 and the bottom part 2 have in the area of the front wall 9 an opening 29, 30, respectively, through which a padlock can be pushed for locking the cover 4 on the bottom part 2. It is also possible to provide an arrangement of an integrated number lock or the like. Means 12 against sliding of the tool boxes transverse to the vertical direction 1 are provided in the area of the bottom part 2, the cover 4, and the sidewalls 6. The means 12 against sliding will be explained in more detail in the following.

Figure 2:
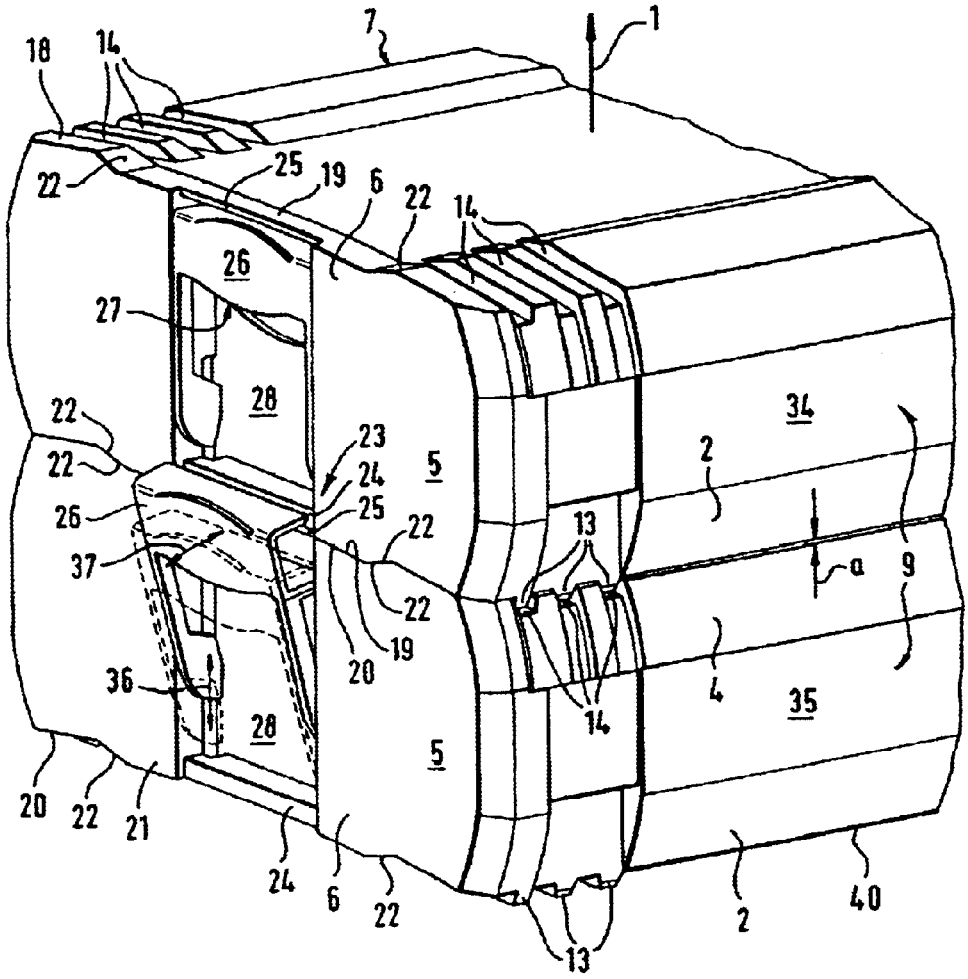
FIG. 2 is a perspective illustration of a stack of tool boxes with connecting clamps embodied as holding grips.

FIG. 2 shows a variant of the tool box according to FIG. 1. Two tool boxes 34, 35 are stacked on top one another and have means 23 for a positive-locking connection in the vertical direction 1 of stacked tool boxes. The sidewalls 6 are embodied as stacking posts 5. The top sides 18 of the sidewalls 6 facing upwardly in the upward vertical direction 1 have a recess 19, respectively, and the opposite bottom sides 20 have a corresponding raised portion 21, respectively, which are delimited laterally by pressure surfaces 22. In this connection, the raised portion 21 of the upper tool box 34 engages the matching recess 19 of the lower tool box 35 wherein the respective pressure surfaces 22 rests against one another and support one another within the plane of the sidewalls 6 counter to the upward vertical direction 1 and transversely thereto. The cover 4 of the lower tool box 35 is closed and rests between the sidewalls 6 forming the stacking posts 5. It has a vertical spacing a (FIG. 2) in the upward vertical direction 1 relative to the bottom part 2 of the tool box 34 stacked on top.

A locking recess 28 is provided in the sidewalls 6. A rib 25 is provided in the recess 28 adjacent to the topside 18, and a rib 24 is provided adjacent to the bottom side 20. A clamp 26, which is embodied as a holding grip 27 and is comprised of injection-molded plastic material, is arranged in the locking recess 28. The clamp 26 can be lifted from its position in dashed lines in the direction of the double arrow 36 and pivoted in the direction of the double arrow 37. The bracket or clamp 26 together with the ribs 24, 25 forms a means for a positive-locking connection of the upper tool box 34 with the lower tool box 35 in the vertical direction.

The means 12 against sliding transversely to the vertical direction 1 provided on the tool boxes 35, 34 comprise also positive-locking engaging projections 13 and guide recesses 14 which adjoin the sidewalls 6 in the area of the front wall 9 and in the area of the back wall 7. The projections 13 are arranged on the respective bottom part 2 and are configured relative to its bottom 40 so that they project from the bottom 40 and can be used, if needed, as legs. The guide recesses 14 are open on both ends in their longitudinal direction so that their positive-locking support action is active in the stacked state transversely to the plane of the sidewalls 6.

Figure 3:
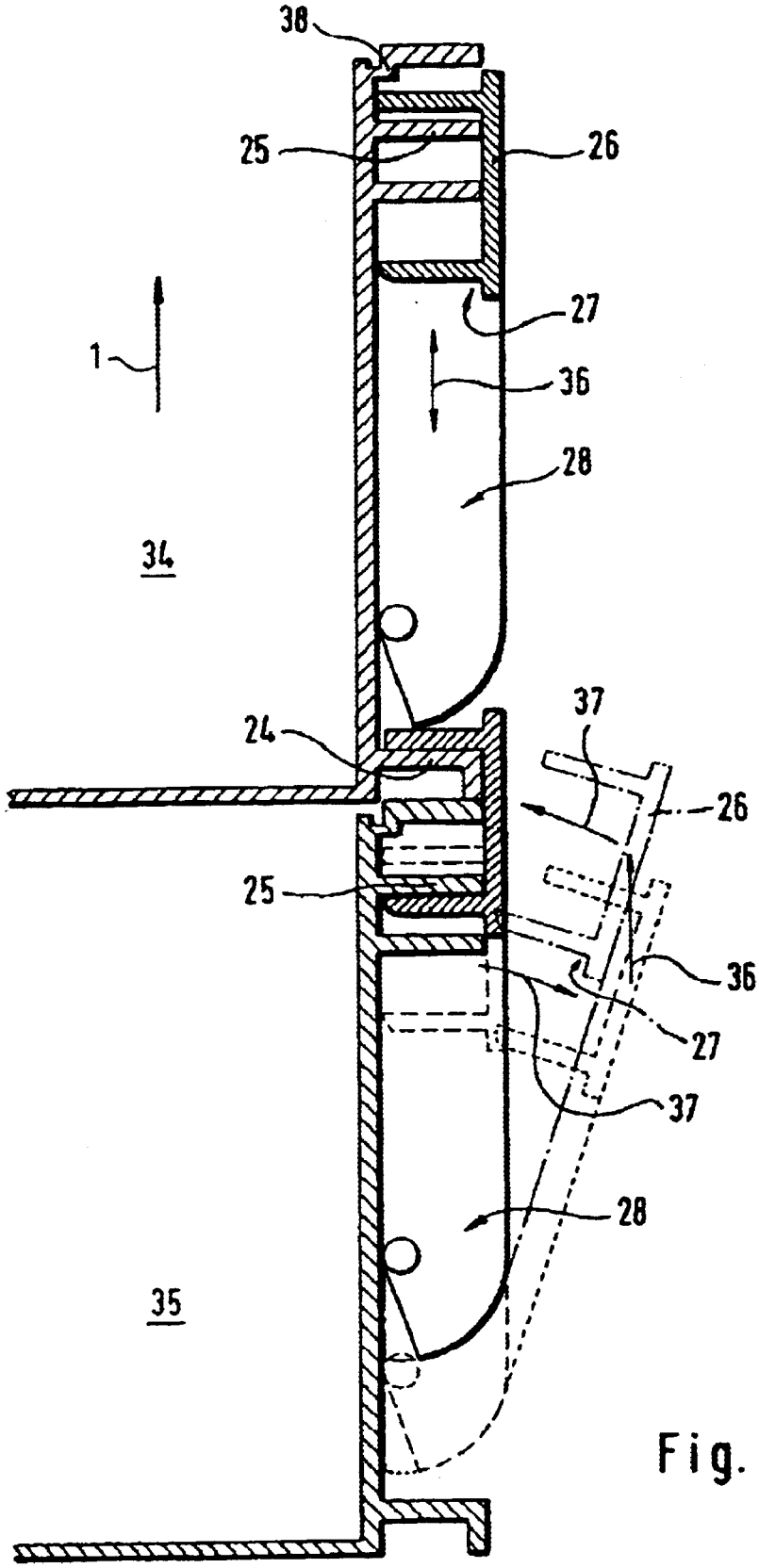
FIG. 3 is a sectional view showing a detail of the stack according to FIG. 2 in the area of the holding grip.

FIG. 3 shows in a sectional detail view the arrangement of FIG. 2 in which the clamp 26 of the upper tool box 34 is illustrated in a rest position and is immersed into the locking recess 28 relative to the outer contour of the tool box 34. In this position, the clamp 26 on the holding grip 27 can be gripped and the stack, comprised of the upper tool box 34 and the lower tool box 35, can be lifted. In the area of the upper rib 25 a stop 38 for the clamp 26, which is movable in the direction of the double arrow 36, is provided. In the area of the lower tool box 35 the clamp 26 is illustrated in a position in which, by means of a combined lifting and pivot movement in the direction of the arrows 36, 37 (FIG. 2), it engages the lower rib 24 of the upper tool box 34 and the neighboring upper rib 25 of the lower tool box 35. In this way, a positive locking connection in the vertical direction 1 is realized. The positive-locking connection of the clamp 26 with the ribs 24, 25 can be provided by clamping or snapping into place. It may also be expedient to provide an elastic spring element for forcing the clamp 26 into place.

Figure 4:
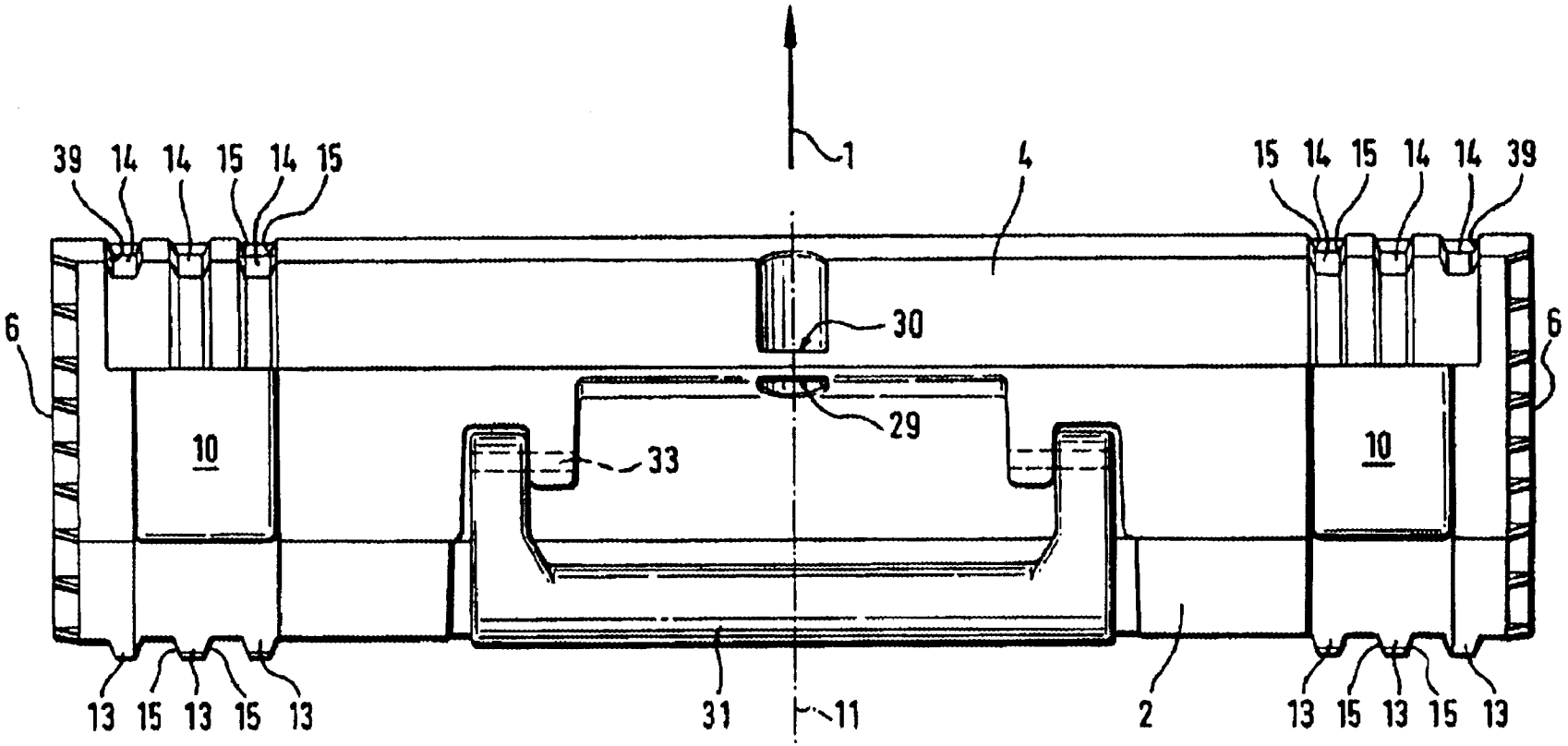
FIG. 4 is a front view of the tool box according to FIG. 1.

FIG. 4 shows a tool box in a front view illustrating that the two closures 10 described before are symmetrically arranged laterally to the centerline 11. The cover 4 has adjacent to the sidewalls 6 guide recesses 14 which are provided with lateral slants 15. On the bottom part 2, correspondingly shaped projections 13 with lateral slants 15 are provided for engagement of the guide recesses 14 of the tool box arranged underneath. The guide recesses 14, which are positioned farthest outwardly and adjoin the respective sidewalls 6, are configured such that the corresponding projections 13 of a bottom part positioned above, but not illustrated, can contact the inner sides 39 of the sidewalls 6.

Figure 5:
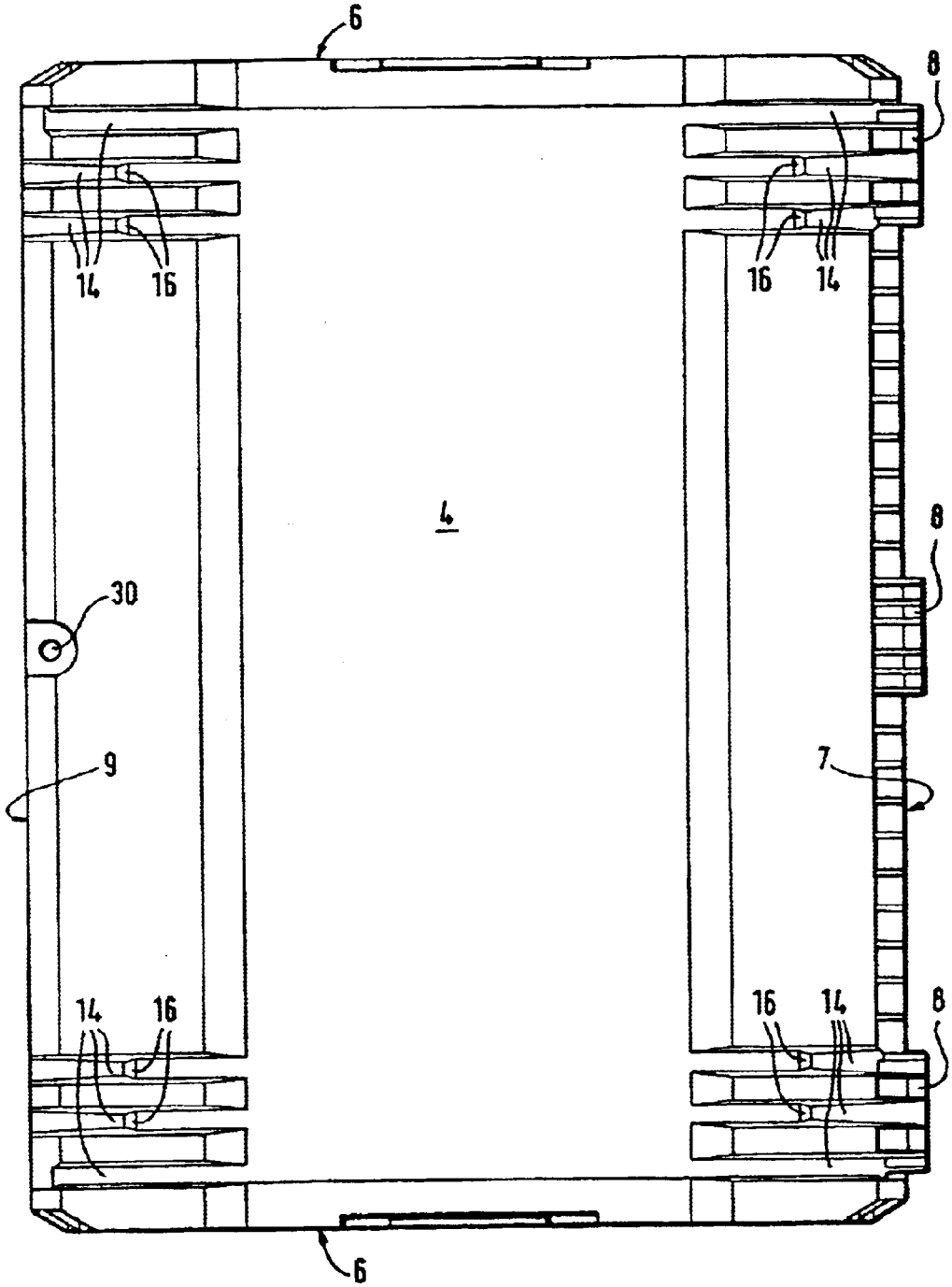
FIG. 5 is a top view of the tool box of FIG. 1.

FIG. 5 shows a plan view of the tool box of FIG. 4 in which the guide recesses 14 are arranged in the area of the front wall 9 and the back wall 7. A portion of the guide recesses 14 in the area of the front wall 9 and the corresponding guide recesses 14 in the area of the back wall 7 have stop surfaces 16. By means of these stop surfaces 16 the oppositely positioned guide recesses 14 are separated from one another such that guiding a projection 13 therethrough in a direction of its longitudinal axis is impaired. The projections 13 engaging these guide recesses 14 are described in connection with FIG. 6 in more detail and have corresponding stop surfaces 17. The cover 4 is pivotably connected by three hinges 8 to the back wall 7 of the bottom part 2 (which bottom part has been illustrated in more detail in the preceding Figures).

Figure 6:
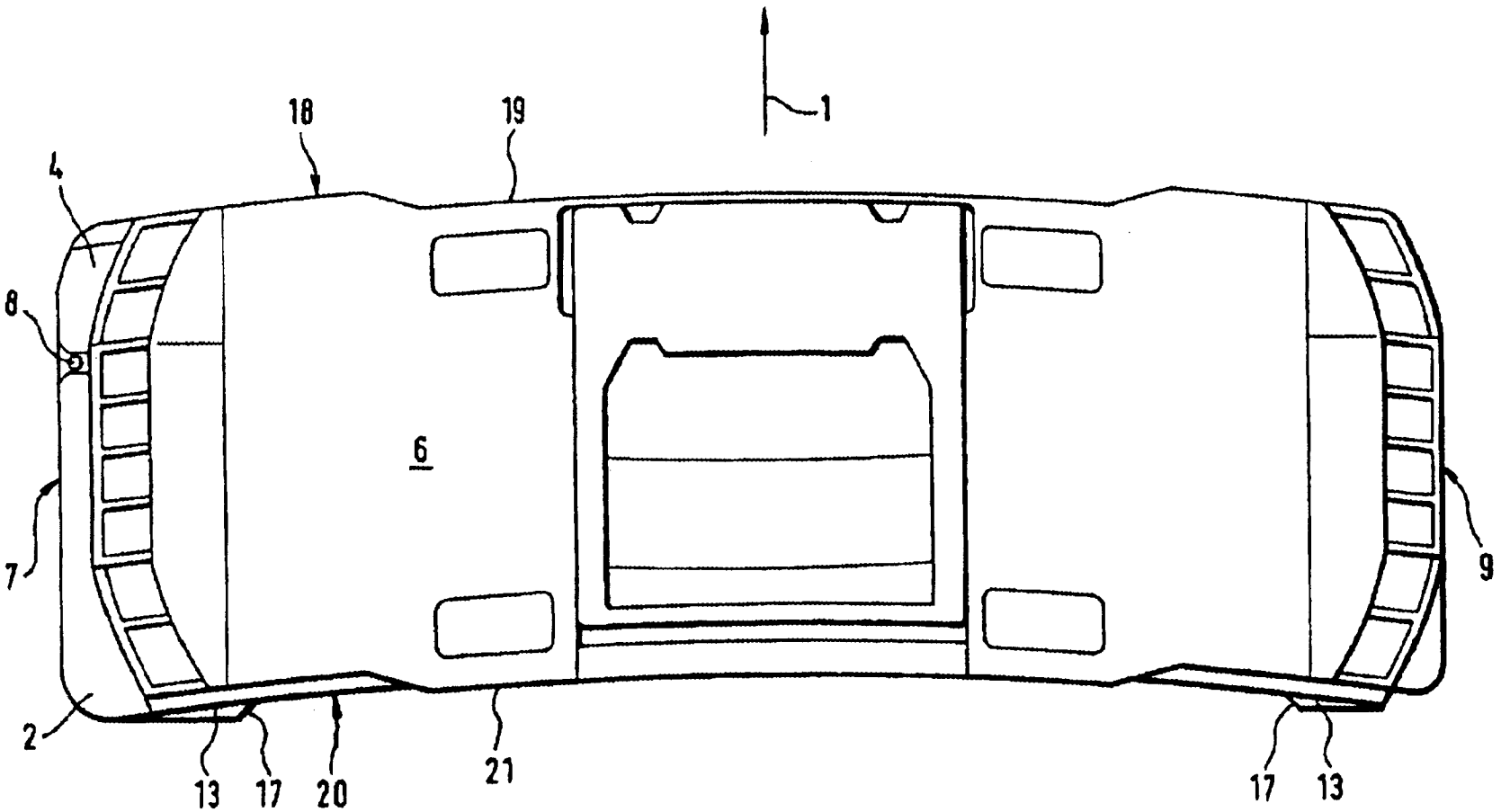
FIG. 6 is a side views of the tool box of FIG. 1.

FIG. 6 shows in a side view the tool box according to FIGS. 4 and 5 in which the topside 18 of the sidewall 6 is convexly curved and the bottom side 49 is curved concavely in a matching way. The projections 13 in the area of the back wall 7 and the back wall 9 of the bottom part 2 have stop surfaces 17 which face one another. In the stacked state, the surfaces 17 rest against the stop surfaces 16, illustrated in FIG. 5, and prevent sliding in the longitudinal direction of the guide recesses 14 of FIG. 5. The projections 13 project downwardly, opposite to the upward vertical direction 1, relative to the bottom 48 and the projection 21 in the sidewall 6 and thus provide support legs.

Figure 7:
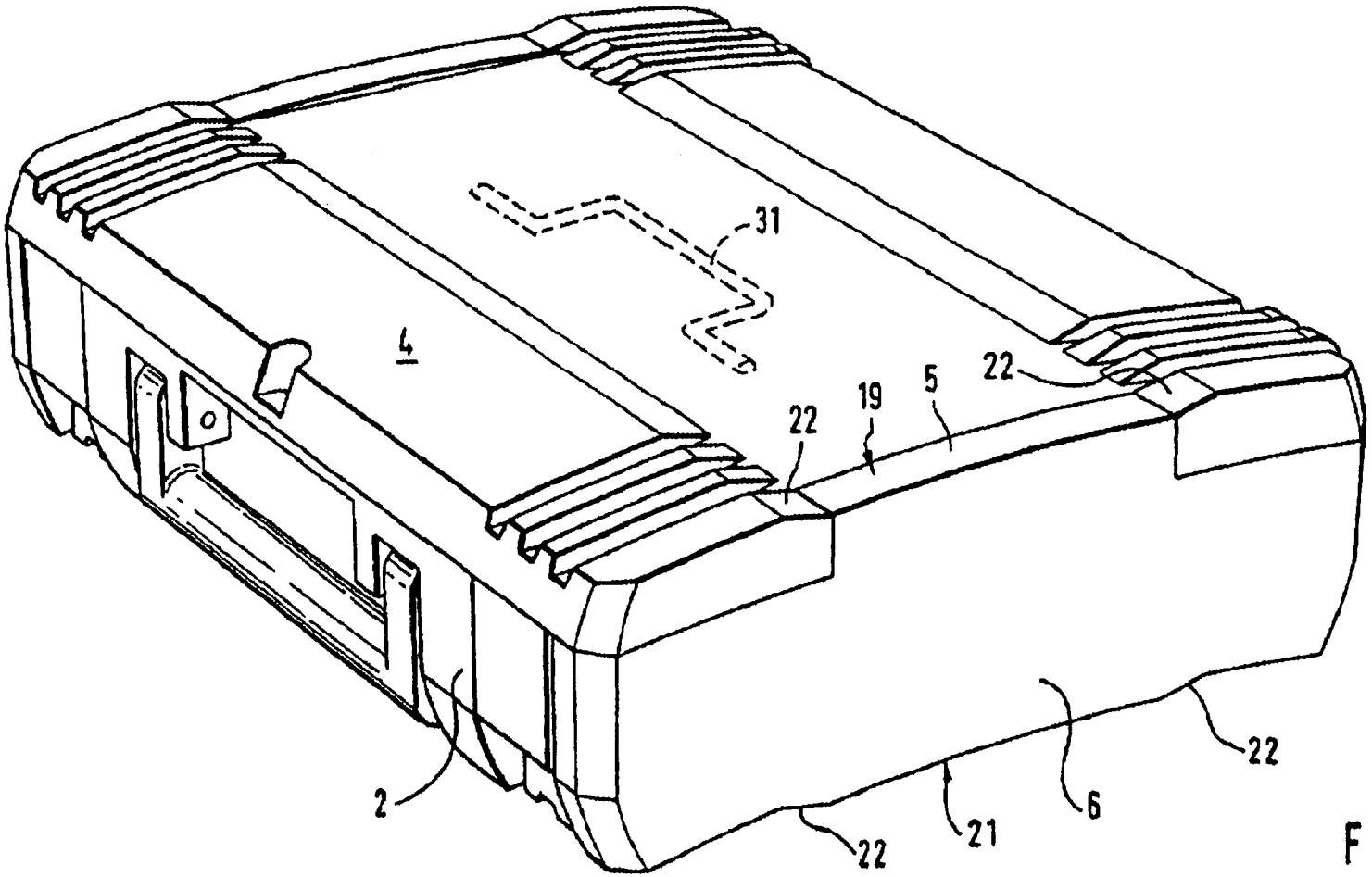
FIG. 7 is a perspective view of another embodiment of the tool box according to FIG. 1.

FIG. 7 shows in a perspective view another embodiment of the tool box according to the invention in which the cover 4 covers the entire base surface of the bottom part 2 with the exception of the central area of the sidewalls 6. The central area of the sidewalls 6 project laterally past the cover 4 in the upward direction and form s stacking post 5 only in the area of the recess 19. The pressure surfaces 22 on the cover 4 are configured such that relative to the corresponding pressure surfaces 22 they are spaced relative to the projection 21 on the bottom side in the stacked state and provide only a securing function relative to lateral sliding. A carrying handle 31 indicated in dashed lines can be provided as an optional feature on the cover 4.

Figure 8:
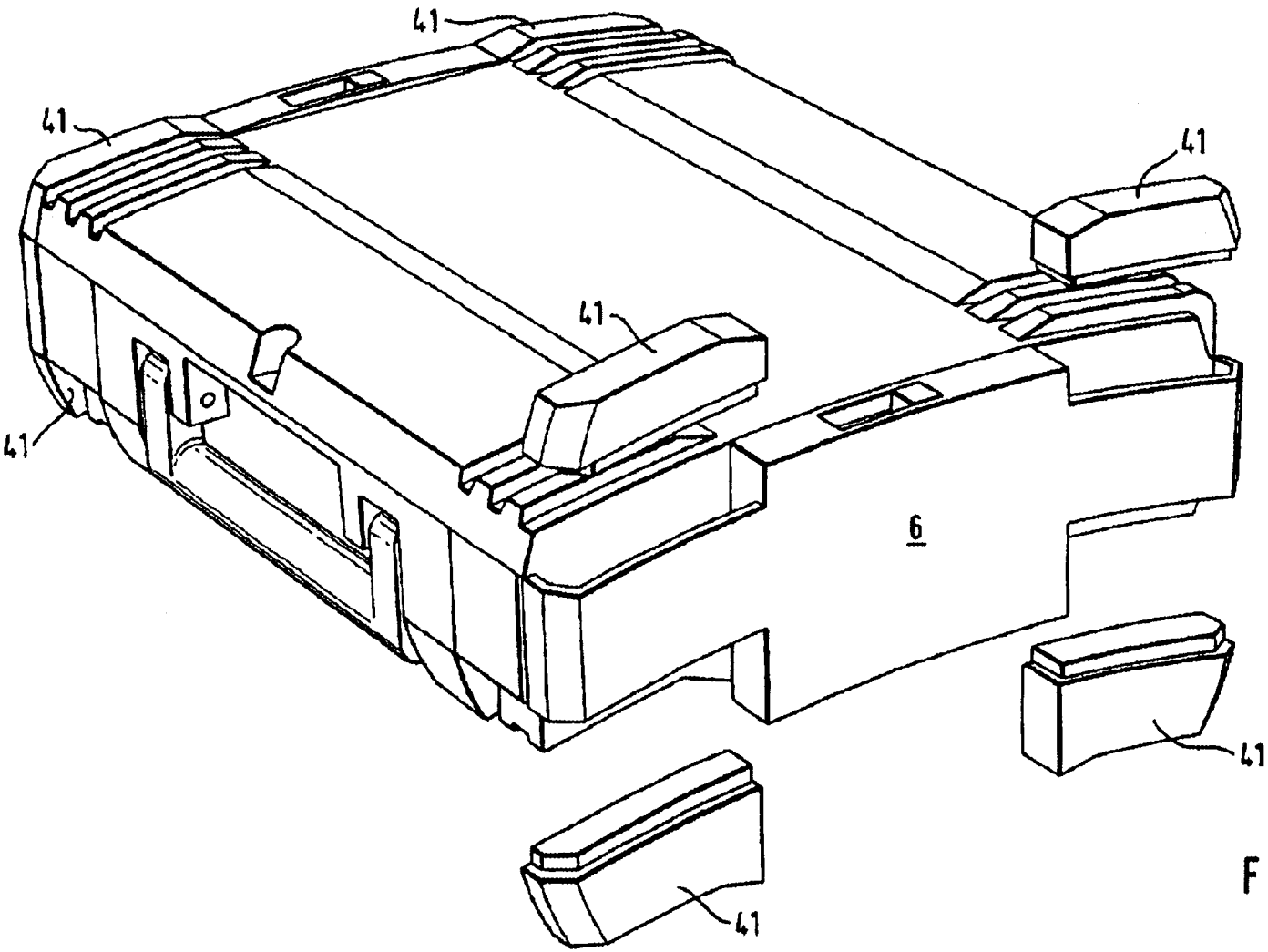
FIG. 8 shows another embodiment of the tool box according to FIG. 1 with shock absorbing elements.

A further embodiments illustrated in FIG. 8 in which elastic shock absorbing elements 41 are provided on the sidewalls 6 which reduce an impact loading, for example, of large or tall stacks of boxes.

FIG. 9 shows in a perspective illustration a tool box 34 which is stacked in a vertical direction 1 onto a tool box in the form of a drawer arrangement 42 positioned underneath. The drawer arrangement 42 has a housing part 43 including sidewalls 6 and an intermediately positioned cover 4 fixedly connected to the sidewalls 6. The sidewalls 6 of the housing part 43 form stacking posts 5 for the tool box 34 positioned on top. Between the stacking posts 5 a drawer 44 is horizontally slidable into and out of the housing part 43 in the direction of double arrow 45. The weight forces which result from the stack formation are received by stacking posts 5 so that the drawer 44 is substantially free of any load. The housing part 43 with regard to further details, in particular, in the area of the sidewalls 6 and the cover 4 is configured comparably to the tool boxes described above in order to enable a stack formation with the described advantages, in particular, with regard to the securing action against lateral sliding.

While specific embodiments of the invention have been shown and described in detail to illustrate the inventive principles, it will be understood that the invention may be embodied otherwise without departing from such principles.

What is claimed is:

1. A stacking tool case vertically stackable with additional stacking tool cases having an identical configuration; the stacking tool case comprising:

a shell-shaped bottom part (2) having an opening (3) facing in an upward vertical direction (1);

a cover (4) configured to close the opening (3);

wherein the bottom part (2) comprises stacking posts (5) extending in the upward vertical direction (1), wherein the cover (4) in a closed state of the tool case is arranged between the stacking posts (5);

wherein the stacking posts (5) are configured to support a bottom part (2) of a stacking tool case placed on top;

wherein the bottom part (2) has two opposed sidewalls (6) having portions extending upwardly past the cover (4), wherein the portions form the stacking posts (5);

wherein the bottom part (2) has a back wall (7) extending between the two opposed sidewalls (6) and a front wall (9) positioned opposite the back wall (7) and extending between the two opposed sidewalls (8), wherein the back wall (7) has hinges (8) connecting the cover (4) pivotably to the back wall (7), the tool case further comprising closure means (10) securing the cover on the front wall (9).

2. The tool case according to claim 1, wherein the cover (4) has a spacing (a) in the upward vertical direction (1) to the bottom part (2) of the stacking tool case placed on top.

3. The tool case according to claim 1, wherein the closure means (10) comprise two closures (10) arranged laterally displaced relative to a vertical center of the front wall (9).

4. The tool case according to claim 1, wherein the closure means (10) are recessed relative to an outer contour of the tool case in the closed state of the tool case.

5. The tool case according to claim 1, further comprising means (12) for preventing sliding of the tool case in a direction transverse to the upward vertical direction (1) relative to the stacking tool case placed on top.

6. The tool case according to claim 5, wherein the means (12) for preventing sliding of the tool case are comprised of projections (13) and guide recesses (14), wherein the projections (13) and the guide recesses (14) engage one another positive-lockingly.

7. The tool case according to claim 6, wherein the projections (13) and the guide recesses (14) have lateral slants (15).

8. The tool case according to claim 6, wherein the projections (13) are provided on the bottom part (2) and project from a bottom (40) of the bottom part downwardly in a direction counter to the upward vertical direction (1).

9. The tool case according to claim 6, wherein the guide recesses (14) are arranged on the cover (4) laterally adjoining the sidewalls (6), respectively, wherein the projections (13) of the bottom part (2) of the tool case placed on top are positioned on an inner side of the sidewalls (6), respectively.

10. The tool case according to claim 6, wherein the guide recesses (14) are arranged near the back wall (7) and near the front wall (9) and are separated from one another by stop surfaces (16), wherein the projections (13) are shaped to match the guide recesses (14) and have stop surfaces (17) matching the stop surfaces (16) of the guide recesses (14).

11. The tool case according to claim 10, wherein the guide recesses (14) are open in a direction toward the back wall (7) and the front wall (9) adjoining the guide recesses (14), respectively.

12. The tool case according to claim 5, wherein the sidewalls (6) have a top side (18) facing upwardly in the upward vertical direction (1) and a bottom side (20) opposite the top side (18), wherein the top side (18) has a recess (19) and wherein the bottom side (20) has a matching raised portion (21) for engaging the recess (19) of the top side (18) of a tool case positioned underneath, wherein the recess (19) and the raised portion (21) have matching pressure surfaces (22) providing a support action within a plane of the sidewalls (6).

13. The tool case according to claim 12, wherein the top side of the sidewalls (6) is convexly curved and the bottom side (20) is concavely curved.

14. The tool case according to claim 1, further comprising means (23) for positive-lockingly connecting in the upward vertical direction (1) identical tool cases (34, 35) in a stacked arrangement.

15. The tool case according to claim 14, wherein the means (23) for positive-lockingly connecting are provided on the stacking posts (5).

16. The tool case according to claim 15, wherein the bottom part (2) has two opposed sidewalls (6) having a top side (18) and a bottom side (20), respectively, wherein the means (23) for positive-lockingly connecting are ribs (24, 25) at the top side (18) and the bottom side (20) of the sidewalls (6) and clamps (26) for engaging the ribs (24, 25).

17. The tool case according to claim 16, wherein the clamps (26) are secured pivotably on the sidewalls (6).

18. The tool case according to claim 17, wherein the clamps (26) are pivotable holding grips (27).

19. The tool case according to claim 14, further comprising a locking recess (28), wherein the means for positive-lockingly connecting are immersible into the locking recess (28).

20. The tool case according to claim 1, wherein the cover (4) is secured lockably on the bottom part (2).

21. The tool case according to claim 20, wherein the bottom part (2) has a front wall (9), wherein the front wall and adjoining area of the cover (4) have an opening (29, 30), respectively, for receiving a locking device.

22. The tool case according to claim 1, wherein the bottom part (2) has a front wall (9) and a pivotable carrying handle (31) arranged on the front wall (9).

23. The tool case according to claim 22, wherein the carrying handle (31) is configured to be pivoted into a recessed position within a contour of the tool case.

24. The tool case according to claim 15, wherein the bottom part (2), the cover (4) and the clamps (26) are made of plastic material.

25. The tool case according to claim 23, wherein the bottom part (2), the cover (4), and the clamps (26) are injection-molded parts.

* * * * *